US005084739A

United States Patent [19]

Kalyandurg et al.

[11] Patent Number: 5,084,739

[45] Date of Patent: Jan. 28, 1992

[54] SELF-LOADING CLEANING BLADE AND HOLDER THEREFOR

[75] Inventors: Satyan R. Kalyandurg, Rochester; Salvatore C. DeFazio, Bergen; Frank Hacknauer, Honeoye Falls, all of N.Y.

[73] Assignee: Eastman Kodak Company, Rochester, N.Y.

[21] Appl. No.: 644,057

[22] Filed: Jan. 22, 1991

[51] Int. Cl.[5] ..... G03G 15/00

[52] U.S. Cl. ..... 355/299; 118/652; 15/256.51; 355/251

[58] Field of Search ..... 355/299, 251, 253, 259; 118/657, 658, 652; 15/236.51

[56] References Cited

U.S. PATENT DOCUMENTS

| | | | |
|---|---|---|---|
| 3,982,498 | 9/1976 | Wilcox | 118/637 |
| 4,044,719 | 8/1977 | Ohmori | 118/652 |
| 4,337,724 | 7/1982 | Hosono et al. | 118/652 |
| 4,396,276 | 8/1983 | Murasaki | 355/299 |
| 4,561,766 | 12/1985 | Fox | 15/256.51 X |
| 4,660,504 | 4/1987 | Weitzel | 118/657 |
| 4,671,207 | 6/1987 | Hilbert | 118/657 |
| 4,742,797 | 5/1988 | Barker | 118/652 |
| 4,839,688 | 6/1989 | Bares | 355/253 |
| 4,990,968 | 2/1991 | Kusuda | 355/326 |

*Primary Examiner*—A. T. Grimley
*Assistant Examiner*—Thu Dang
*Attorney, Agent, or Firm*—Tallam I. Nguti

[57] ABSTRACT

A cleaning apparatus which is loadable against a surface to be cleaned has a L-shaped self-loading blade, a holding member, and supporting members including a retaining pin and a spring member. The cleaning blade includes a base section and a cleaning section which can move relative to each other from unloaded positions to loaded positions.

11 Claims, 4 Drawing Sheets

FIG. 1
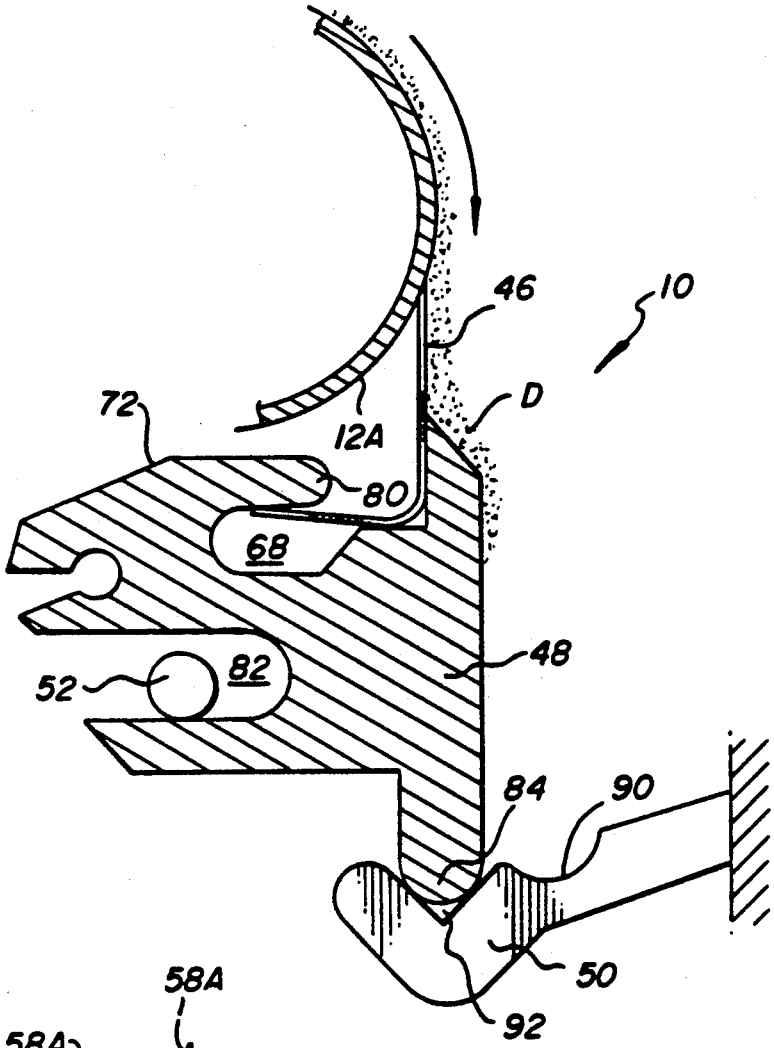
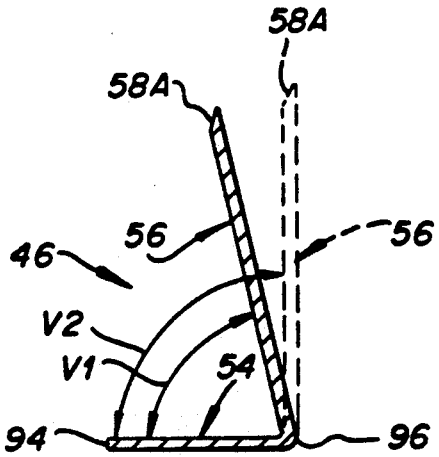
FIG. 3A
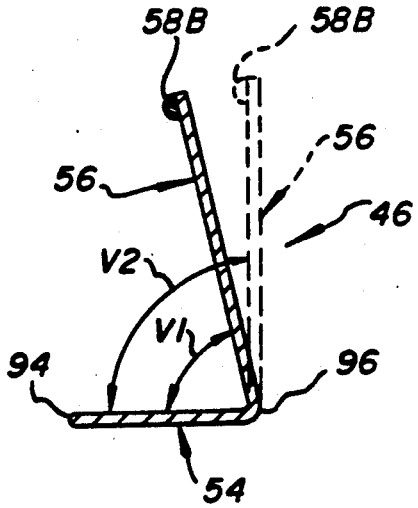
FIG. 4

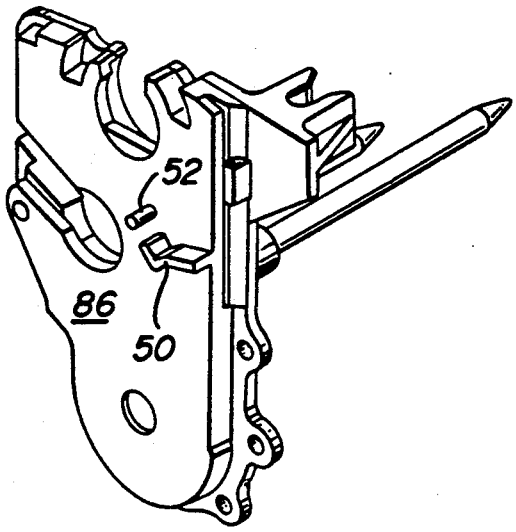
FIG. 7B
FIG. 7A
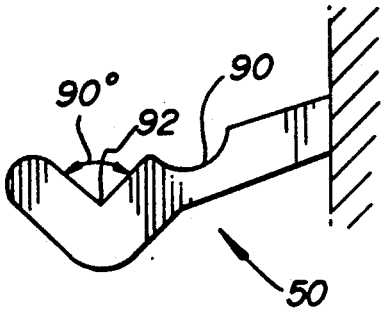
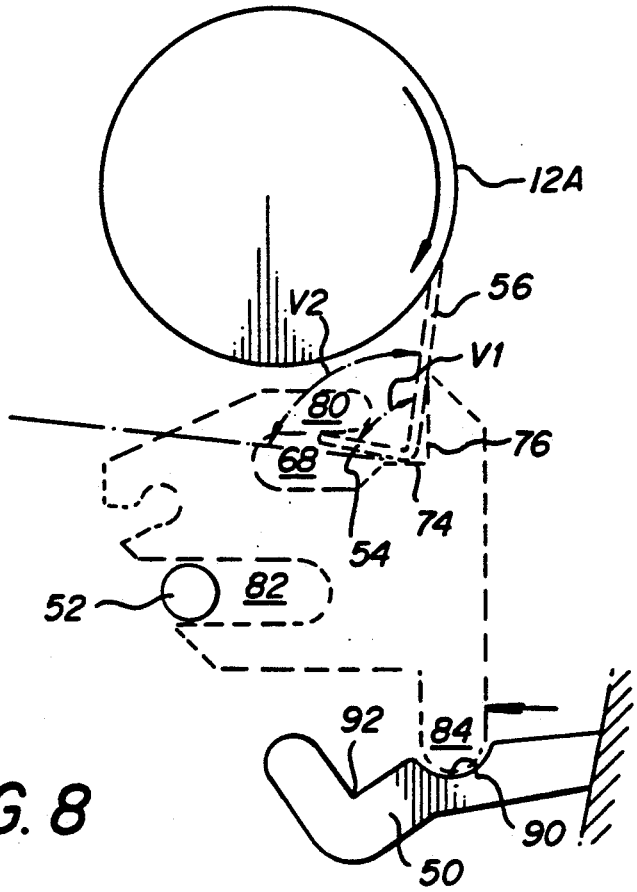
FIG. 8

SELF-LOADING CLEANING BLADE AND HOLDER THEREFOR

BACKGROUND OF THE INVENTION

1. Field of the Invention

This invention relates to cleaning devices for removing developer material particles from a surface to be cleaned in an electrostatographic reproduction apparatus. More particularly, the present invention relates to a self-loading cleaning blade, and a holding member therefor, that are used to remove spent developer material from the surface of the development roller of an electrostatographic development apparatus.

2. Description Relative to the Prior Art

Electrostatographic reproduction apparatus which produce or reproduce copies of an original image on a suitable substrate are well known. Such apparatus typically operate through a sequence of currently well known steps. These steps include (1) charging of the insulated photoconductive surface with electrostatic charges, (2) forming a latent image electrostatically on such surface by selectively discharging areas on such surface, (3) developing the electrostatic image so formed with particles of toner, (4) transferring the toned image to a suitable substrate for fusing thereon to form a permanent record, and (5) cleaning or removing residual toner and/or other particles from the photoconductive and other image-carrying surfaces in preparation for similarly producing another image.

The quality of the images produced by such apparatus depends significantly on the ability to clean the photoconductive and other such surfaces before they are again used to form subsequent images. Several types of cleaning apparatus, including blade-type apparatus, have therefore been developed for that purpose. The long-term effectiveness of any such cleaning apparatus, however, depends significantly on its ability to make desired uniform contact with the surface to be cleaned, and to wear uniformly. This is particularly true of blade cleaning apparatus. In order to achieve and maintain such desired uniform contact and desired uniform wear, the cleaning edge of the blade must be loaded with a substantially precise force against the surface to be cleaned. Such an edge must then maintain such loading within a predetermined range even while it is being worn out. Such precise loading is necessary for preventing damage to the surface being cleaned, as well as for ensuring the effective removal of particles such as very small toner and magnetic carrier particles which adhere to the surface being cleaned. Such removal is particularly a problem when the surface being cleaned is magnetic such as that of the magnetic development roller of a development unit.

Blade cleaning apparatus or mechanical skives used for removing developer material particles from the surface of such a magnetic development roller are disclosed, for example, in U.S. Pat. Nos. 3,982,498 issued to Wilcox on Sept. 28, 1976; 4,044,719 issued to Ohmori on Aug. 30, 1977; 4,337,724 issued to Hosono et al. on July 6, 1982; 4,660,504 issued to Weitzel on Apr. 28, 1987; and 4,671,207 issued to Hilbert on June 9, 1987. To improve the effectiveness of the cleaning blade in the '719 patent, a vibrator is provided for connection to the cleaning blade. In the '504 patent the blade is made adjustably tensionable. Typically, however, such blades or skives as disclosed require multiple components and expensive mounting devices, as well as tools for such mounting. Ordinarily too, precise loading of the cleaning edge of each such blade against the surface being cleaned is difficult to achieve and to maintain without frequent adjustments. As a consequence, uniform loading is also difficult to achieve and to maintain especially given a wearing out of the cleaning edge.

SUMMARY OF THE INVENTION

It is an object of the present invention to provide a simple cleaning device for effectively removing developer material particles from a surface to be cleaned in an electrostatographic reproduction apparatus.

It is another object to provide such a cleaning device which can load against such surface with a substantially precise force, and which can maintain such loading within a desired range even while suffering wear.

It is a further object to provide such a cleaning device which is easy to mount and which requires no tools for such mounting as well as no adjustments after such mounting.

It is still another object of the present invention to provide such a cleaning device for removing developer material particles from the surface of the magnetic development roller of an electrostatographic development apparatus.

In accordance with the present invention, a cleaning device is provided which is loadable against a surface to be cleaned in an electrostatographic reproduction apparatus for removing developer material particles therefrom. The cleaning device includes a resilient member having an L-shape which includes a base section and a cleaning section. The cleaning device also includes a particle removing element associated with the cleaning section of the resilient member. The base and resilient members each has an unloaded position and a loaded position relative to each other such that the base and cleaning sections form a first lap angle when in the unloaded positions, and a second lap angle when in the loaded positions.

BRIEF DESCRIPTION OF THE DRAWINGS

In the detailed description of the invention presented below, reference is made to the drawings, in which:

FIG. 1 is a cross-sectional view of the cleaning apparatus of the present invention shown in the loaded position against a surface to be cleaned;

FIG. 3A is a section of the resilient member or blade of the present invention;

FIG. 4 is another embodiment of the resilient member of the present invention including an attached particle removing element;

FIG. 7A is a schematic of the spring support member of the present invention;

FIG. 7B is an inside view of an end wall of the development apparatus of FIG. 2 showing the spring member and retaining pin of the present invention; and FIG. 8 is a schematic illustrating the cleaning device of the present invention in the first recess of the spring member of FIG. 7A.

DETAILED DESCRIPTION OF THE PREFERRED EMBODIMENT

Figure 2:
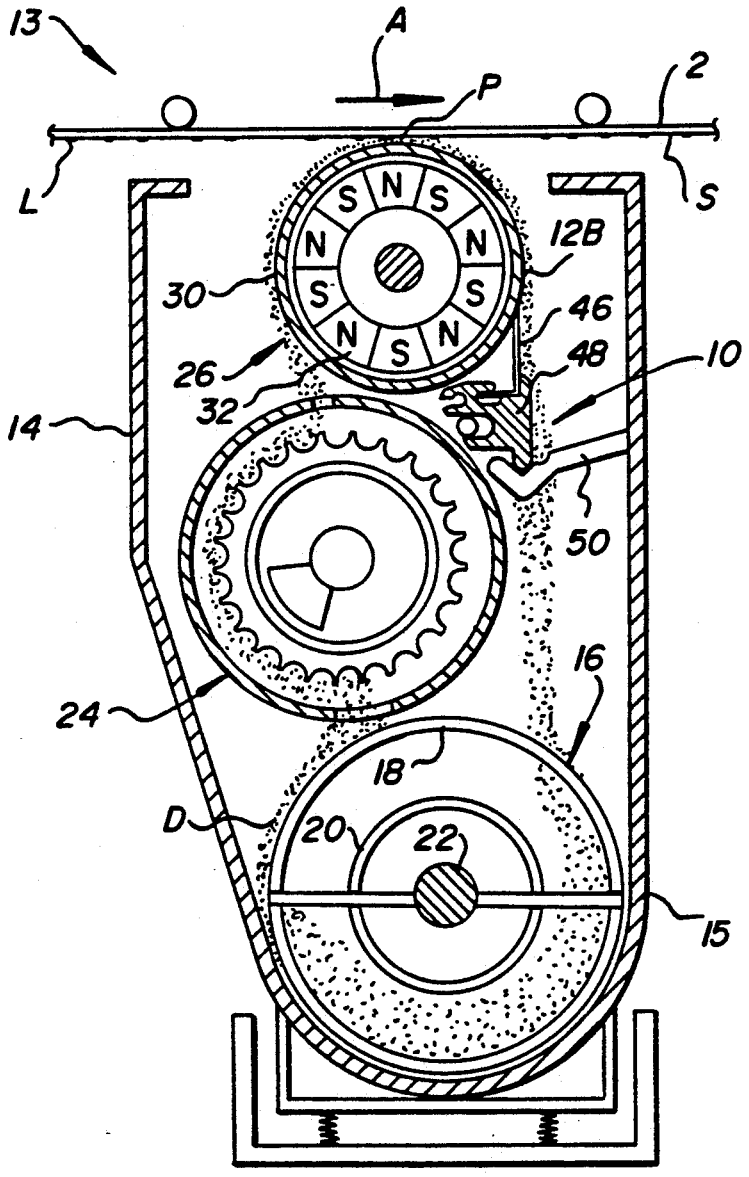
FIG. 2 is a front end sectional view of an electrostatographic development apparatus including the cleaning apparatus of the present invention.

Referring now to FIGS. 1 and 2 of the drawings, the cleaning apparatus of the present invention is shown generally as 10 in a loaded position relative to a surface to be cleaned. The apparatus 10 is particularly useful in an electrostatographic reproduction apparatus such as a copier or printer for removing developer material particles D from a moving surface 12A, 12B therein. The surface 12A FIG. 1, for example, can be an image-bearing surface such as that of a photoconductor, or that of an image transfer roller. In particular, the apparatus 10 as shown in FIG. 2 is useful in the development apparatus 13 of such a copier or printer for removing magnetic developer material particles D from the surface 12B of the magnetic development roller of such apparatus.

As shown in FIG. 2, the development apparatus 13 is a magnetic roller-type apparatus and is mountable in an electrostatographic copier or printer that includes an image-bearing member 2. The image bearing member 2 as shown is movable relative to the development apparatus 13 in the direction, for example, of the arrow A. As shown, the apparatus 13 is adapted to supply developer material D containing marking or toner particles for developing latent charge images L on the image-bearing surface S of the member 2.

The development apparatus 13 comprises a housing 14 having a sump portion 15 for holding a supply of the developer material D. Developer material D consists, for example, of small hard magnetic carrier particles and of fusable marking or toner particles. The carrier and toner particles are chargeable triboelectrically by means of a rotatable ribbon blender 16 mounted in the sump portion 15.

The ribbon blender 16 may comprise an outer ribbon 18 and an inner ribbon 20. Both inner and outer ribbons are coiled concentrically about, and movable by a driven shaft 22. Movement of the ribbons 18 and 20 agitates the carrier and toner particles in order to uniformly mix and charge the particles to a desired charge level, and to a desired toner concentration. The ribbons then move the particles for delivery to a feed mechanism shown as 24. As shown, the feed mechanism 24 is located between the ribbon blender 16 and a magnetic brush or roller development means 26. Feed mechanism 18, as located, receives and feeds the charged carrier and toner particles to the magnetic development roller 26 which is located at the top of the housing 14 within an opening therein.

The development roller 26 may be of any suitable construction, and can include a non-magnetic shell 30 and a magnetic core 32. The shell 30 has an outer surface 12B, and is rotatable about the core 32. The core 32 consists of a plurality of permanent magnets which are arranged in an alternating N-S pole pattern, and which can be rotated, for example, in a clockwise direction.

As shown, a portion of the development roller 26 projects through the opening in the top of the housing 14 such that when the apparatus 13 is properly mounted in a copier or printer, the projecting portion will lie directly adjacent, or within a desired proximity to the latent images L on the surface S of the flexible image-bearing member 2. The proximity should be such that toner particles will be transferred to the images L when developer material D consisting of charged carrier particles and such toner particles is transported on the magnetic roller 26 past such images L. Such transfer of toner particles represents the development step of the electrostatographic process.

Such development which occurs within a region or development nip indicated, for example, as P, reduces the charge levels and toner concentration of the spent developer material on the shell 30. Such spent developer material particles must therefore be removed from the surface of the shell 30 before the shell again rotates to pick up fresh developer material from the means 24 that has the desired toner concentration and the desired charge levels for high quality development.

Figures 3B, 5, 6:
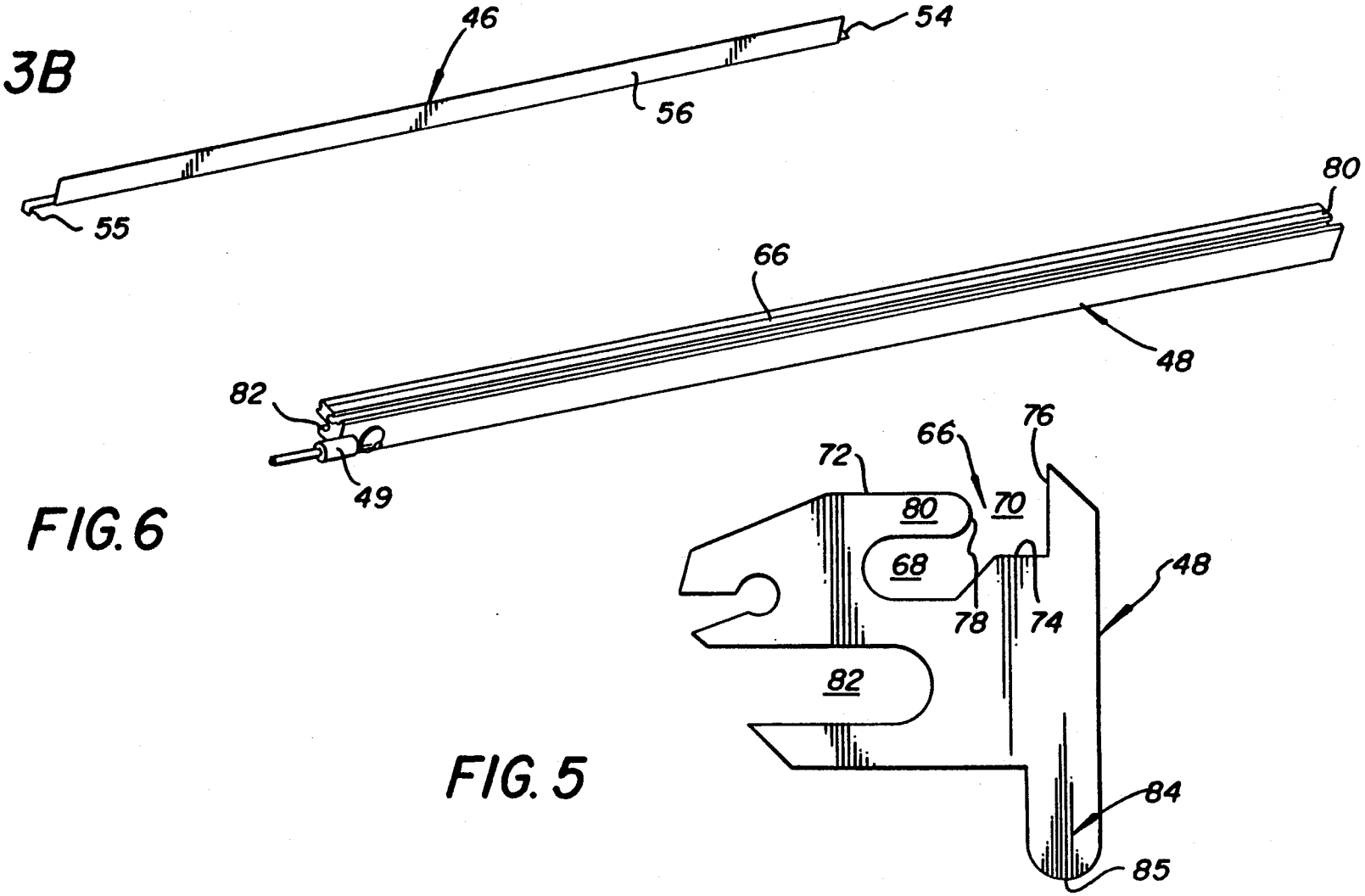
FIG. 3B is a perspective schematic of the cleaning blade of FIG. 3A.
FIG. 5 is an end view of the holding member of the cleaning apparatus of the present invention.
FIG. 6 is a perspective schematic of the holding member of FIG. 5 including electrical contact means.

Accordingly, as shown in FIGS. 1 and 2, the cleaning apparatus 10 of the present invention is provided for removing the spent developer material from the surface 12B of the shell 30. As shown, the cleaning apparatus 10 includes a cleaning device 44 consisting of a resilient cleaning member 46 shown in the form of a blade, and a holding member 48 for holding the blade 46. The cleaning apparatus 10 also includes supporting means shown as 50 and 52 which are useful for supporting the cleaning device 44 relative to the surface 12A, 12B to be cleaned. Referring now to FIGS. 1 to 3B, the resilient member or blade 46 has an L-shape including a base section 54 and a cleaning section 56. The cleaning section 56 includes a cleaning edge 58A thereto. The blade or member 46 is made, for example, from an elongate strip of cold rolled stainless steel about 0.005 of an inch thick. The strip, as such, should be longer than the width or cross-dimension of the surface being cleaned. As shown in FIGS. 3A and 3B, the strip is simply bent lengthwise into an L-shape that includes the base section 54 and cleaning section 56. The base section 54 may additionally include means such as a tab portion 55 for locating the entire blade 46 relative to the width or cross-dimension of the surface being cleaned.

As bent, the base and cleaning sections 54, 56 respectively of the blade 46 each has an unloaded or free-state position and a loaded or spring-back force applying position relative to each other. The sections 54, 56 being L-shaped form a first lap angle V1 when in the unloaded positions, and a second lap angle V2 when in the loaded positions. In FIG. 3A, the cleaning section 56 is shown moving or being deflected alone from its relative unloaded position defining the first lap angle V1 with the base 54 to its loaded position defining the second lap angle V2. It should be understood, however, that either or both sections 54, 56 can move or be deflected relative to one another or to each other in going from the unloaded to the loaded positions of the blade 46. As shown, the first lap angle V1 is narrower than the second lap angle V2 so there is an inherent tendency in the sections 54, 56 when in their V2 positions, to want to return to their positions with respect to V1.

For cleaning the surface 12B of the magnetic development roller 26 of the development apparatus 13, the blade 46 can be made from a strip of cold rolled steel which is about 0.005"(inch) thick and which has an overall width of about 14.5 mm. When bent into the L-shape of the base and cleaning sections 54, 56, the base section 54 can be about 4 mm wide, and the cleaning section 56 about 10.5 mm wide. The size of the angles V1, V2, that of these sections as well as the characteristics of the material used principally determine the range of forces with which the cleaning section loads against the surface 12B. For example, the first lap angle V1 is made to be substantially 86° and the second lap angle V2 substantially 90° for a loading force range of about 0.17–0.67 lbs/in. In addition, the cleaning edge 58A should be shaped appropriately in order to allow desired contact with such surface 12B.

Referring now to FIG. 4, a modified embodiment of the resilient member 46 is shown in which the means for removing the developer material particles is not an integral blade edge 58A, but an attached cleaning element 58B such as a foam pad. Otherwise, the sections 54, 56 of the member 46, as shown, are structured and behave similarly to those of the blade 46 through the lap angles V1 and V2.

As also shown in FIGS. 1, 2 and 5–6, the cleaning apparatus 10 includes a holding member 48 for holding the resilient member or blade 46. The holding member 48 can be extruded from an aluminum alloy, and includes electrical contact means 49 (FIG. 6) for biasing the surface to cleaned through the blade 46. As such, the blade 46 should preferably be made of electrically conductive material. The holding member 48 also includes means shown generally as 66 for receiving the base section 54 of the resilient member or blade 46. The receiving means 66 consists of a clearance slot 68, and an exterior channel 70 which is formed into a first side 72 of the holding member 48. As shown, particularly in FIG. 5, the channel 70 has a base surface 74, and first and second side surfaces 76, 78. The clearance slot 68 is formed extending, for example, in an orientation substantially at right angles to the channel 70. As such, the slot 68 is formed partially into the base surface 74 as well as partially into the second side surface 78 of the channel 70.

The holding member 48 also includes means for retaining the resilient member or blade 46 in the loaded position of FIGS. 1 and 2 and in the unloaded position, for example, as shown in FIG. 8. The blade retaining means includes the first side surface 76 of the channel 70, the remaining part of the base surface 74 which adjoins the first side surface 76, and a lip portion 80. The lip portion 80 as shown is defined partially by the second side surface 78 of the channel 76, and the clearance slot 68. As further shown, the holding member 48 includes means for mounting the holding member. Such mounting means includes a pin receiving slot 82 for mounting the holding member 48 along a first axis, and a leg portion 84 on a second side of the holding member for mounting along a second axis. The distal end 85 of the leg portion 84 is radiused.

Referring in particular to FIGS. 7A and 7B, the cleaning apparatus 10 further includes means 50, 52 for supporting the cleaning device 44 against the surface 12A, 12B to be cleaned. As shown, the means 50 is a cantilevered spring member for urging the holding member in a first direction, and the means 52 is a retaining member, such as a pin, which is received into the slot 82. The spring member 50 operates to urge the holding member 48 against the pin 52. When the cleaning apparatus 10 is used in a development apparatus 13 as shown in FIG. 2, the spring member 50 and the pin 52 are mounted on each end wall 86 (FIG. 7B) of the development apparatus 13.

The spring member 50 includes first and second recesses 90, 92 for positioning and holding the leg portion 84 of the holding member 48 relative to the surface 12A, 12B to be cleaned. The first recess 90, as shown is radiused, and the second recess 92 is V-shaped, with a lap angle of about 90°. The transition portion between the first recess 90 and the second recess 92 is slightly radiused on leaving the first recess to the second recess.

According to the present invention, the cleaning device 44 of the cleaning apparatus 10 can be assembled easily and manually. It can also be mounted easily and manually against the surface 12A, 12B to be cleaned. To assemble the resilient member or blade 46 to the holding member 48, the distal end 94 of the base section 54 is inserted through the channel 70. The insertion should be made along or near the second side surface 78 of the channel 70 so as to directly access the clearance slot 68. The blade or resilient member 46 is then rotated clockwise per the orientation, for example, of FIG. 5. Such rotation of the member or blade 46 should bring the angled portion 96 of the blade 46 to rest partially against the base surface 74 and the first side surface 76 of the channel 70.

To mount the cleaning device 44 on the spring member 50 and to the retaining pin 52, the leg portion 84 is initially positioned in the first recess 90 in the spring member 50, and then tilted towards the surface to be cleaned. The cleaning edge 58A of the blade 46 is allowed to come to rest against such surface, for example, the surface 12B. In this position, the base section 54 and cleaning section 56 of the blade are essentially in their unloaded positions therefore forming the first lap angle V1. The longer or wider cleaning section 56 in such position is capable of acting as a flat spring against the surface. This initial position is illustrated in FIG. 8.

To cause the cleaning edge 58A of the blade 46 to self-load against the surface 12B, the leg portion 84 thereof is slightly pushed manually out of the first recess 90, over the radiused transition portion, into the V-shaped second recess 92.

Slightly pushing the leg portion 84 into the V-shaped recess 92 for positioning and holding therein causes the sections 54, 56 of the resilient member or blade 46 to move from their unloaded positions defining the first lap angle V1 into their loaded positions defining the second lap angle V2. In effect, during such pushing, the distal tip 94 of the base section 54 is caught against the lip portion 80 and the cleaning edge 58A is pressed against the surface 12B thereby causing the sections to spread and the angled portion 96 thereof as well as the base and first side surfaces 74, 76 of the channel 70 to move into a retaining position by such surfaces.

The resilient member or blade 46 is designed so that spreading the base and cleaning sections 54, 56 from the first angle V1 (unloaded) to the greater second angle V2 (loaded) induces a spring-back force in the cleaning edge 58A thereof. In the specific blade described above for cleaning the surface 12B of a magnetic development roller 26, the spring-back force of the blade was found to lie substantially within a desired and precise range of 0 17–0.67 lbs/in. The spring-back self-loading characteristics of the blade 46 are such that the force of the blade loading against the surface 12B is maintained substantially within such range even given a wearing out of the cleaning edge 58A. As such, the effective life of the blade is significantly increased. Such loading is also therefore uniform thus resulting in uniform contact as well as effective cleaning of the surface 12B.

As can be seen, the cleaning apparatus of the present invention is additionally simple and relatively less expensive. It can be easily assembled as well as easily mounted manually as described for effectively removing magnetic developer material particles D from the surface for example of a magnetic development roller 26.

The invention has been described in detail with particular reference to a presently preferred embodiment, but it will be understood that variations and modifications can be effected within the spirit and scope of the invention.

What is claimed is:

1. A cleaning blade loadable against a surface to be cleaned in an electrostatographic reproduction apparatus for removing developer material particles therefrom, the cleaning blade including:

(a) a base section for manually inserting into a blade holder, said base section being made from a resilient material;

(b) a cleaning section having a cleaning tip for engaging and scraping the surface to be cleaned, said cleaning section being made from the same resilient material as said base section, said cleaning section and said base section being formed from a single strip of such resilient material bent at an angle into said cleaning section and said base section, said cleaning section having an unloaded position as bent relative to said base section, said cleaning section being deflectably movable relative to said base section, and having a loaded position relative to said base section when deflectably moved;

(c) a first lap angle formed by said base section and said cleaning section when said cleaning section is in said unloaded position; and (d) a second lap angle formed by said base section and said cleaning section when said cleaning section is deflectably moved into said loaded position, said first and second lap angles being such as to cause said cleaning section when in said loaded position to possess a spring-back force for self-loading said cleaning tip against the surface to be cleaned.

2. The cleaning blade of claim 1 wherein said resilient material is stainless steel.

3. The cleaning blade of claim 1 wherein said first lap angle is 86°.

4. The cleaning blade of claim 1 wherein said second lap angle is 90°.

5. The cleaning blade of claim 1 wherein said base section includes a tab at a first end thereof for manually locating said cleaning blade relative to the width of the surface being cleaned.

6. The cleaning blade of claim 1 wherein said self-loading spring-back force is within a range of 0.17–0.67 lbs./in.

7. A cleaning device for removing developer material particles from a surface to be cleaned in an electrostatographic reproduction apparatus, the cleaning device comprising:

(a) a cleaning blade having:

(i) a base section for manually inserting into a blade holder, said base section being made from a resilient material;

(ii) a cleaning section having a cleaning tip for engaging and scraping the surface to be cleaned, said cleaning section being made from the same resilient material as said base section, said cleaning section and said base section being formed from a single strip of such resilient material bent at an angle into said cleaning section and said base section, said cleaning section having an unloaded position as bent relative to said base section, said cleaning section being deflectably movable relative to said base section, and having a loaded position relative to said base section when deflectably moved;

(iii) a first lap angle formed by said base section and said cleaning section when said cleaning section is in said unloaded position; and (iv) a second lap angle formed by said base section and said cleaning section when said cleaning section is deflectably moved into said loaded position, said first and second lap angles being such as to cause said cleaning section when in said loaded position to possess a spring-back force for self-loading said cleaning tip against the surface to be cleaned; and (b) a holding member for holding said cleaning blade, said holding member comprising:

(i) means for receiving said base section of said blade, said receiving means including a clearance slot and an elongate exterior channel formed into a first side of said holding member, said channel having a base surface, a first side surface, and a second side surface, said clearance slot being formed partially into said base surface and into said second side surface of said channel; and (ii) means for retaining said cleaning blade against the surface to be cleaned, said retaining means including said first side surface of said channel, a portion of said base surface of said channel adjoining said first side surface thereof, and a lip portion defined partially by said second side surface of said channel and said clearance slot for catching a distal end of said base section of said blade.

8. The cleaning device of claim 7 including means for supporting the cleaning device against the surface to be cleaned, said supporting means including a retaining pin and a cantilevered spring member for urging the cleaning device in a first direction against said retaining pin.

9. The cleaning device of claim 8 wherein said cantilevered spring member includes a first recess and a second recess for supporting a leg portion of the holding member of said cleaning device in an unloaded position and in a loaded position, respectively, said first recess and said second recess being formed so as to allow the leg portion of said holding member to be slid manually from one to the other of said first and second recesses.

10. The cleaning apparatus of claim 9 wherein said second recess in said spring member is V-shaped.

11. A development apparatus for developing latent images on an image-bearing surface in an electrostatographic reproduction apparatus using developer material particles, the development apparatus comprising:

(a) a housing including a sump portion for holding developer material particles;

(b) means within said sump portion for mixing and feeding the developer material particles;

(c) a development roller for moving developer material particles fed from said sump portion into a particle-applying relationship with latent images on the image-bearing surface; and (d) a cleaning device for removing developer material particles from said development roller, the cleaning device including:

(i) a cleaning blade having:

(A) a base section for manually inserting into a blade holder, said base section being made from a resilient material;

(B) a cleaning section having a cleaning tip for engaging and scraping the surface to be cleaned, said cleaning section being made from the same resilient material as said base section, said cleaning section and said base section being formed from a single strip of such resilient material bent at an angle into said cleaning section and said base section, said cleaning section having an unloaded position as bent relative to said base section, said cleaning section being deflectably movable relative to said base section, and having a loaded position relative to said base section when deflectably moved;

(C) a first lap angle formed by said base section and said cleaning section when said cleaning section is in said unloaded position; and (D) a second lap angle formed by said base section and said cleaning section when said cleaning section is deflectably moved into said loaded position, said first and second lap angles being such as to cause said cleaning section when in said loaded position to possess a spring-back force for self-loading said cleaning tip against the surface to be cleaned; and (ii) means including a cantilevered spring for holding and supporting said cleaning blade against the surface to be cleaned.

* * * * *